US011067066B2

(12) United States Patent
Bozic et al.

(10) Patent No.: US 11,067,066 B2
(45) Date of Patent: Jul. 20, 2021

(54) HARMONIC DISTRIBUTION RADIAL PISTON HYDRAULIC MACHINE

(71) Applicant: POCLAIN HYDRAULICS INDUSTRIE, Verberie (FR)

(72) Inventors: Anté Bozic, Verberie (FR); Nicolas Ternoy, Verberie (FR); Christophe Gouzou, Verberie (FR); Sébastien Gonzalez, Verberie (FR); Bamdad-Soufi Djahanchah, Verberie (FR)

(73) Assignee: POCLAIN HYDRAULICS INDUSTRIE, Verberie (FR)

( * ) Notice: Subject to any disclaimer, the term of this patent is extended or adjusted under 35 U.S.C. 154(b) by 300 days.

(21) Appl. No.: 15/740,874

(22) PCT Filed: Jul. 1, 2016

(86) PCT No.: PCT/FR2016/051667
§ 371 (c)(1),
(2) Date: Dec. 29, 2017

(87) PCT Pub. No.: WO2017/001802
PCT Pub. Date: Jan. 5, 2017

(65) Prior Publication Data

US 2018/0187661 A1 Jul. 5, 2018

(30) Foreign Application Priority Data

Jul. 1, 2015 (FR) ..... 1556203

(51) Int. Cl.
*F04B 1/0452* (2020.01)
*F03C 1/047* (2006.01)
(Continued)

(52) U.S. Cl.
CPC ..... *F04B 1/0452* (2013.01); *F03C 1/047* (2013.01); *F03C 1/0435* (2013.01);
(Continued)

(58) Field of Classification Search
CPC ..... F04B 1/0452; F04B 1/0417; F04B 1/047; F04B 1/1071; F04B 1/1072; F03C 1/047; F03C 1/0472; F03C 1/0435; F03C 1/247
(Continued)

(56) References Cited

U.S. PATENT DOCUMENTS 5,358,388 A * 10/1994 Schutten ..... F01B 3/0032 417/269
6,978,713 B2 * 12/2005 Allart ..... F03C 1/0444 91/498
(Continued)

FOREIGN PATENT DOCUMENTS

EP 0665364 A1 8/1995
FR 2940672 A1 7/2010
(Continued)

*Primary Examiner* — Dustin T Nguyen
(74) *Attorney, Agent, or Firm* — The Webb Law Firm

(57) ABSTRACT

The hydraulic machine includes a cam and a cylinder block with pistons co-operating with cam lobes, each of which has two ramps extending between top and bottom dead center arcs. The cylinders are connected in alternation to a feed and to a discharge, in sequences separated by switchover stages including an isolation stage during which they are isolated relative to the feed and discharge main ducts. The angular position of the start or of the end of at least one first isolation stage relative to the corresponding dead center arc is different from the angular position of the start or of the end of at least one second isolation stage relative to its corresponding dead center arc, both of these dead center arcs being top dead center arcs or both of them being bottom dead center arcs.

20 Claims, 8 Drawing Sheets

(51) Int. Cl.

| | |
|---|---|
| ***F04B 1/047*** | (2020.01) |
| ***F04B 1/1071*** | (2020.01) |
| ***F03C 1/34*** | (2006.01) |
| ***F03C 1/247*** | (2006.01) |

(52) U.S. Cl.
CPC ..... *F03C 1/0472* (2013.01); *F03C 1/247* (2013.01); *F04B 1/047* (2013.01); *F04B 1/1071* (2013.01)

(58) Field of Classification Search
USPC ..... 91/491, 498; 92/72
See application file for complete search history.

(56) References Cited

U.S. PATENT DOCUMENTS

| | | | | |
|---|---|---|---|---|
| 7,185,579 | B2 * | 3/2007 | Allart | F03C 1/0444 91/491 |
| 7,603,941 | B2 * | 10/2009 | Lemaire | F03C 1/0444 417/273 |
| 9,074,578 | B2 | 7/2015 | Souply et al. | |
| 2016/0131117 | A1 | 5/2016 | Balenghien et al. | |

FOREIGN PATENT DOCUMENTS

| | | | |
|---|---|---|---|
| JP | 2004116455 | A | 4/2004 |
| WO | 03056171 | A1 | 7/2003 |
| WO | 03056172 | A1 | 7/2003 |
| WO | 2014199041 | A1 | 12/2014 |

* cited by examiner

HARMONIC DISTRIBUTION RADIAL PISTON HYDRAULIC MACHINE

CROSS-REFERENCE TO RELATED APPLICATIONS

This application is the United States national phase of International Application No. PCT/FR2016/051667 filed Jul. 1, 2016, and claims priority to French Patent Application No. 1556203 filed Jul. 1, 2015, the disclosures of which are hereby incorporated in their entirety by reference.

BACKGROUND OF TITLE INVENTION

Field of the Invention

The present invention relates to a hydraulic machine having pistons, mounted in a cylinder block, and co-operating with a cam, the cylinders in which the pistons slide being connected sequentially to a hydraulic fluid feed and to a hydraulic fluid discharge so as to cause the cylinder block and the cam to rotate relative to each other.

In particular, the machine may be a hydraulic motor or a pump.

Description of Related Art

In this type of machine, the pressures in the cylinders undergo intense variations, at high rates. Such pressure shocks generate vibration in the machine and sound emissions.

The sound emissions have a fundamental frequency, which is associated with the number of pistons and to the speed of the machine, said fundamental frequency being determined by the number of alternations between the high pressure states and the low pressure states over one full rotation of the rotor of the machine at a uniform rate. A significant portion of the sound emissions, which portion tends to generate a siren-like whine, is due to harmonic excitation of that very narrow fundamental frequency. That creates a harmonic spectrum that is said to be "poor", with frequency peaks that are spaced apart and at high level. Thus, an important aspect of reducing the sound emissions consists in avoiding or at least in limiting harmonic excitation from a narrow fundamental frequency, because the whine that such a fundamental frequency and its harmonic frequencies generate is deemed to be particularly unpleasant and contributes strongly to the general impression of sound nuisance.

In a hydraulic machine having axial pistons, European Patent Application No. 0 665 364 proposes randomly offsetting the communication orifices of the cylinders relative to the axes of said cylinders, via which orifices the cylinders are connected in alternation to the feed and to the discharge, which axes are parallel to the axis of rotation of the rotor of the machine since that machine has axial pistons (which axis is referred to below as the "axis of the machine"). Taking up that idea, Application WO 2014/199041 seeks to improve it by making provision for offsetting that is not random, but rather that takes place in alternation at one end or the other end of an offsetting range.

However, such offsets are not applicable to a hydraulic machine of the type having radial pistons, and for which the axes of the cylinders are perpendicular to the axis of the machine.

For a machine of the type having radial pistons, PCT Patent Applications WO 03/056171 and WO 03/056172 relate to a hydraulic motor having a fluid distributor in which the distribution face (in which the distribution orifices are situated that are connected either to the feed or to the discharge) is perpendicular to the axis of rotation and bears against the communication face of the cylinder block (in which the communication orifices of the cylinders open out in such a manner as to communicate sequentially with the distribution orifices). Those patent applications propose to provide particular arrangements on the edges of the distribution orifices or on the edges of the communication orifices, in such a manner as to enable a pressure-compensating volume of fluid to pass through at the time(s) when correspondence between a communication orifice and a distribution orifice starts and/or ends.

Those provisions make it possible to avoid pressure shocks on opening and closing the connections between the distribution orifices and the communication orifices, and thus to reduce the initial intensity of the sound emissions at the fundamental frequency, but they do not make it possible to reduce, per se, the harmonic excitations of such emissions from the fundamental frequency.

SUMMARY OF THE INVENTION

For a hydraulic machine having radial pistons, an object of the present invention is to improve the above-mentioned state of the art so as to reduce sound emissions, in particular by acting on the excitation phenomena of the machine at a fundamental frequency, so as to make it less harmonic. In particular, by making provision for the switchovers to take place at a less uniform rate than in the prior art, the invention aims to broaden the range of frequencies covered by fundamental excitations, thereby avoiding generating a fundamental frequency that is practically pure, i.e. very narrow; this contributes to lowering the sound levels of the fundamental excitation and of the harmonics that are generated. The harmonics that combine together are fewer in number, and in general of lower level, thereby making the sound effect lower and less unpleasant. In particular, this contributes to reducing whining or strident modulations.

Thus, the present invention provides a hydraulic machine having radial pistons and comprising a cam and a cylinder block that are suitable for turning relative to each other about an axis of rotation, the cylinder block having radial cylinders connected to communication orifices of the cylinder block, pistons mounted to slide in the cylinders being suitable for co-operating with the cam, which has a plurality of lobes, each having two ramps, each of which extends between a top dead center arc and a bottom dead center arc, the machine further comprising a fluid distributor suitable for connecting the communication orifices to a first or second main duct for feed or discharge, in sequences comprising connection stages during which said communication orifices are connected to the first main duct and connection stages during which they are connected to the second main duct, which stages are separated by switchover stages that comprise, in succession, closing the connection to one of the main ducts, an isolation stage during which the communication orifices are isolated from the two main ducts, and opening the connection to the other main duct, each isolation stage taking place, for the communication orifice of any given cylinder, while the piston mounted in the cylinder is bearing on a given dead center arc, which is defined as being the dead center arc that is associated with the isolation stage in question, the angular position of the start or of the end of an isolation stage relative to the dead center arc that is associated with said isolation stage being defined as being the angular difference between said start or said end and the bisector of the angle covered by said dead center arc that is associated with said isolation stage.

In this machine, the angular position of the start or the end of at least one first isolation stage relative to the dead center arc that is associated with the first isolation stage is different from the angular position of the start or the end of at least one second isolation stage relative to the dead center arc that is associated with said second isolation stage during one revolution cycle of the machine, and the dead center arcs associated with said first and second isolation stages are of the same type, i.e. they are both top dead center arcs or both bottom dead center arcs.

Each of the lobes of the cam of the hydraulic machine having radial pistons of the invention has two ramps, each of which extends between a top dead center arc and a bottom dead center arc. In these dead center arcs, the distance from the cam lobe to the axis of the machine is constant, i.e. when a piston is in contact with the dead center arc (this contact take place, in general, via a roller carried by the piston), its distal end bearing against the cam remains at a fixed distance from the axis of rotation. Thus, in this dead center arc, the cylinder in which the piston finds itself is, in principle, not connected either to the fluid feed or to the fluid discharge. This is a safety range, over which communication between the cylinder and the fluid feed or fluid discharge is closed. In particular, when the contact zone over which the piston is in contact with the cam comes into the top dead center arc, communication is closed between the cylinder in which said piston slides and the fluid feed, so the cylinder remains isolated from the feed over a portion of the dead center arc corresponding to the isolation stage and then, when the piston comes towards the end of the dead center arc, the cylinder becomes connected to the fluid discharge. The same phenomenon takes place in opposite manner when the piston co-operates with the bottom dead center arc, since it is then firstly communication between the cylinder and the fluid discharge that closes, and then communication between said cylinder and the fluid feed that opens after the isolation stage. The isolation stages that take place over the top or bottom dead center arcs correspond to safety stages, avoiding any short-circuits between the fluid feed and the fluid discharge.

In accordance with the invention, advantage is taken of the angular range covered by the dead center arcs to offset the isolation stages a little relative to one another, in order to avoid uniform repetition, at a given frequency, of the times at which the connections between the cylinders and the feed or discharge main ducts open or close.

In addition, in accordance with the invention, this offsetting between the isolation stages is implemented for dead center arcs of the same type, i.e. the isolation stages of various top dead center arcs and/or the isolation stages of various bottom dead center arcs are offset relative to one another during one cycle of rotation. It is between dead center arcs of the same type, top or bottom, that the phenomena of repetition at a given frequency runs the greatest risk of giving rise to exciting the machine at a fundamental frequency. This applies in particular for all of the bottom dead center arcs, in particular for the rates at which the connections to the feed main duct are opened, and for all of the top dead center arcs, in particular for the rates at which the connections to the discharge main duct are opened.

Thus, in accordance with the invention, when the hydraulic machine is a hydraulic machine having radial pistons, the harmonic noise due to the openings and closures of the cylinder ducts over dead center arcs of the same type is limited.

Optionally, for each switchover stage, the difference between the angular position of the start of the isolation stage and the start of the dead center arc that is associated with said isolation stage, and the difference between the angular position of the end of the isolation stage and the end of said dead center arc is not less than $1/20^{th}$, and preferably not less than $1/10^{th}$, of the angle covered by said dead center arc. In particular, when the above-mentioned difference lies in the range $1/20^{th}$ to $1/2$, or indeed in the range $1/20^{th}$ to $1/3$, or indeed in the range $1/10^{th}$ to $1/6^{th}$ of the angle covered by the dead center arc, a margin is advantageously made available for implementing the offsets between the isolation stages, while also obtaining an excellent safety margin against any risk of short-circuiting because there remains an angular dead center arc range that is sufficiently large for the isolation stages. At the same time, since the isolation stage starts after the dead center arc starts and ends before the dead center arc ends, this avoids the phenomena of shocks and of cavitation that would result from any momentary losses of the piston bearing with pressure against the cam.

Optionally, for each switchover stage, the length of arc between the angular position of the start of the isolation stage and the start of the dead center arc that is associated with said isolation stage, and the length of arc between the angular position of the end of the isolation stage and the end of said dead center arc are not less than 0.1 millimeters (mm).

Thus, in order to implement the offset between the first and second isolation stages, the margin procured by the above-mentioned values is available between the starts or the ends of the isolation stages and the starts or the ends of the dead center arcs.

For a hydraulic machine having radial pistons, of the low speed and high torque type, there are generally from 5 to 16 pistons, depending on the cylinder capacity and the torque desired for the machine. For such a machine having radial pistons and of known type, e.g. having a cylinder capacity lying in the range 50 cubic centimeters ($cm^3$) to 25,000 $cm^3$ (the cylinder capacity being the volume of fluid passing through the cylinders of the machine for one full revolution of the rotor), an excellent safety margin is obtained with respect to any risks of short-circuits, while also retaining a dead center arc length available for the isolation stages that is sufficiently long when the arc lengths between the start or the end of the dead center arc and the start or the end of the isolation stage lie approximately in the range 0.1 mm to 0.5 mm, in particular approximately in the range 0.1 mm to 0.2 mm.

Optionally, the absolute value of the difference between the angular positions of the start or of the end of the first and second isolation stages is not less than $1/20^{th}$, and preferably not less than $1/10^{th}$, of the angle covered by the smaller of the dead center arcs that are associated with the first and second isolation stages.

In certain machines, the length of arc covered by all of the dead center arcs of the same type, top or bottom, is analogous. In certain machines, the angular range covered by all of the dead center arcs, top or bottom, is analogous. In other machines, the cam lobes may be asymmetrical or different from one another, so that the length of arc of the dead center arcs of the same type or their angular range may vary. It has been observed that the offset between the above-mentioned first and second isolation stages makes it possible to reduce significantly the excitation of harmonic frequencies, while also preserving the necessary safety margins.

Optionally, the difference between the angular positions of the start or of the end of the first and second isolation stages covers an arc having a length not less than 0.1 mm.

Optionally, the fluid distributor may be a distributor that, for each cylinder or each group of cylinders, has a distribution valve controlled so as to connect the communication orifice(s) associated with the cylinder or with the group of cylinders in question to the first main duct or to the second main duct, depending on the position(s), relative to the lobes of the cam, of the piston(s) that slide(s) in said cylinder(s).

Such a distributor is, for example, known from French Patent Application No. 2 940 672

In accordance with another option, the fluid distributor is provided with distribution orifices suitable for being connected to either one of the main ducts and for being successively in register with the communication orifices of the cylinder block while the cylinder block and the cam are rotating relative to each other, each distribution orifice corresponding to a ramp of the cam.

It is then considered that the distributor is a distributor of the hydraulic type. For example, it may be a distributor of the central type, disposed inside the cylinder block, and having its distribution orifices opening out in an outer axial face, which is cylindrical, the communication orifices of the cylinder block being situated on the inner axial periphery of said cylinder block that co-operates with the outer axial face of the distributor.

It may also be a distributor of the plane type, having its distribution orifices opening out in a radial face perpendicular to the axis of the machine, bearing against a radial face of the cylinder bock, in which face the communication orifices open out. By way of example, a distributor of this type is described in PCT Applications WO 03/056171 and WO 03/056172, and is shown in FIG. 1 described below.

Optionally, the first and second isolation stages concern the communication orifice of the same cylinder, the angular position of the start or of the end of the first isolation stage that takes place while the piston mounted in the same cylinder is bearing against a first dead center arc being offset relative to the angular position of the start or of the end of the second isolation stage that takes place while the piston mounted in said same cylinder is bearing against a second dead center arc different from the first.

Thus, the offset of the first and second isolation stages is implemented by the cam, i.e. it is observed between two different cam lobes. In particular, when the fluid distributor is of the hydraulic type, this offset may be implemented by appropriate offsets in the positions of the distribution orifices. In particular, for a distributor of the hydraulic type that is part of a hydraulic machine having radial pistons, the distributor is provided with a distribution orifice for each ramp of each cam lobe, and each distribution orifice is normally centered on the bisector of the angle covered by the ramp of the cam lobe to which the orifice in question corresponds. In this situation, the above-mentioned offsetting of the invention can be implemented by off-centering some of the distribution orifices relative to said bisectors.

Thus, with the first and second dead center arcs being respectively situated at one end of a first ramp and at one end of a second ramp, it is possible to choose that the position of the distribution orifice corresponding to the first ramp and the position of the distribution orifice corresponding to the second ramp are at a first offset relative to each other, which positions are relative to the bisectors of the angles covered by the respective ramps.

This is particularly valid for machines in which the cam lobes are symmetrical, i.e. in which the ramps of each cam lobe are symmetrical about a radius passing through the crest of the lobe and, in particular, for machines in which all of the cam lobes are identical. However, this can also apply to machines having cam lobes that are asymmetrical, and not necessarily identical to one another.

The above-mentioned first and second cam ramps may be ramps of the same type, i.e. they may both be ramps that are upwards or downwards when considered in a given direction of rotation of the rotor of the machine.

In this situation, with the first and second ramps being respectively ramps of a first cam lobe and of a second cam lobe, it is also possible to choose that the position of the distribution orifice corresponding to the other ramp of the first cam lobe, and the position of the distribution orifice corresponding to the other ramp of the second cam lobe are, relative to each other, at the same offset as the first offset, which positions are relative to the bisectors of the angles covered by the respective other ramps.

As indicated above, this is applicable to hydraulic machines in which all of the cam lobes are identical, to machines in which all of the cam lobes are symmetrical without necessarily being identical, or indeed to machines in which the cam lobes are asymmetrical, regardless of whether or not they are identical.

Optionally, the first and second isolation stages concern the same dead center arc, the angular position of the start or of the end of the first isolation stage that takes place while a piston mounted in a first cylinder is bearing against the same dead center arc being offset relative to the angular position of the start or of the end of the second isolation stage that takes place while the piston mounted in a second cylinder that is different from the first cylinder is bearing against said same dead center arc.

The first and second isolation stages are then subjected to "cylinder" offsetting, due to the communication orifices being offset.

In this situation, it is possible to choose that the communication orifices of the first and second cylinders have different configurations relative to the respective axes of said first and second cylinders.

This difference in configuration may be implemented by choosing communication orifices of the same shape, but with different positions. In particular, for a hydraulic machine in which all of the cam lobes are identical, offsetting of this type is not obtained if all of the identical communication orifices are spaced apart uniformly relative to one another. In this situation, based on such a machine, offsetting may be obtained by modifying a little the spacing between certain communication orifices, so that the spacing becomes non-uniform.

The above-mentioned difference in configuration may also be obtained by acting on the shape of the communication orifices.

Optionally, the angular positions of the starts or of the ends of at least three isolation stages, referred to as "offset isolation stages", are different, with different values of at least one of the parameters chosen from among the amplitude of the isolation stages and the angular offsets of the positions of the starts or ends of the offset isolation stages being distributed between said offset isolation stages, advantageously using the PRBS method, the different values being fewer in number than the number of offset isolation stages.

For example, it is possible to take into account all of the isolation stages and three offset indices: −1, 0, and +1. Among these indices, the index 0 corresponds to a zero offset value (no offset), while the indices +1 and −1 correspond to a given absolute offset value (measured either in length of dead center arc, or in angular range) made either in the clockwise rotation direction, or in the counterclockwise rotation direction. These three offset values can then be assigned to different isolation stages in random manner, or else by using a PRBS (Pseudo-Random Binary Sequence) method. It is then possible to reason in the same way with only values 0 and 1 or indeed with only the values +1 and −1, or indeed with a different number of offset values, e.g. by choosing a plurality of offset indices, which may particularly, but not exclusively, be prime numbers or numbers that are mutually prime, being positive or negative, and by choosing an absolute offset value multiplied by said indices.

Thus, the angular positions of the starts or the ends of at least three isolation stages are different and thus have angular offsets relative to one another, these offsets having the same absolute value and having different directions, these directions advantageously being distributed using the PRBS method.

Optionally, for all of the isolation stages in which the angular positions of the starts or ends of strokes are different, the offsets are in the same direction, the offsets advantageously being distributed using the PRBS method.

For example, the following sequence may be implemented for choosing the offset indices of the isolation stages concerning a cam ramp and the various pistons of a machine coming successively into contact with said ramp (in this example, this is thus "piston" offsetting).

This sequence is shown in Table 1 below. It is a sequence of the $2^3$ PRBS type, i.e. the sequence starts from two indices 0 or 1 distributed over 7 successive states in "position 1" and "position 2", the distribution of which is thus repeated as from the $8^{th}$ state, the sequence $2^3$ giving the "position 3" and the offset index used is then the one that gives the PRBS sequence for this "position 3". To apply the sequence to piston offsetting, the pistons are numbered with the successive states, by going round the cylinder block in a direction of rotation starting from an origin piston. If, as in the example below, there are more than 7 pistons, the numbering of the states is started over at the $8^{th}$ piston. For the isolation stages concerning the pistons for which "position 3" in the following table is 1, there is an offset of 1 times the determined absolute offset value, whereas, for the isolation stages concerning the pistons for which "position 3" in the following table is 0, there is no offset. The example given is for a machine having 12 radial pistons, numbered 1 to 12, going round the cylinder block in a given direction of rotation, starting from a piston chosen to be the origin. Naturally, the same sequence is possible for cam offsetting, between the various distribution orifices considered successively by going though the distributor in a given direction. For example, with 12 successive states, as in Table 1, it is possible to define cam offsetting for a machine having 12 cam ramps, i.e. 6 cam lobes.

In a $2^3$ sequence, "position 3" (which, in this example, is the value chosen for the offset index) is repeated in groups of 7 successive states, the 8th state being identical to the first. The particular data found in position 3 associated with states 1 to 7 is of relevance and is illustrated in Table 1 below:

TABLE 1

| State | Piston | Position 1 | Position 2 | Position 3 | Offset |
|---|---|---|---|---|---|
| 1 | 1 | 0 | 0 | 1 | yes |
| 2 | 2 | 1 | 0 | 0 | no |
| 3 | 3 | 0 | 1 | 0 | no |
| 4 | 4 | 1 | 0 | 1 | yes |
| 5 | 5 | 1 | 1 | 0 | no |
| 6 | 6 | 1 | 1 | 1 | yes |
| 7 | 7 | 0 | 1 | 1 | yes |
| 1 | 8 | 0 | 0 | 1 | yes |
| 2 | 9 | 1 | 0 | 0 | no |
| 3 | 10 | 0 | 1 | 0 | no |
| 4 | 11 | 1 | 0 | 1 | yes |
| 5 | 12 | 1 | 1 | 0 | no |

Table 2 below shows a PRBS sequence of the 24 type, i.e. starting from 2 values (0 or 1), 15 states are defined that are repeated as from the 16th state, and 4 positions are determined, "position 4" being the value chosen for the offset index. For piston offsetting, the states correspond to the successive pistons. For cam offsetting, the states correspond to the successive cam ramps. Table 2 takes the example of piston offsetting, for a machine having 16 pistons, or the example of cam offsetting for a machine having 8 cam lobes, i.e. 16 ramps. It is possible to consider the ramps in groups. The 16 ramps are formed by 8 upward ramps (the cylinder of a piston that co-operates with such a ramp is in the feed stage), and 8 downward ramps (the cylinder of a piston that co-operates with such a ramp is in the discharge stage). It is possible to consider that the distribution orifice corresponding to an upward ramp and the distribution orifice corresponding to a downward ramp adjacent to said upward ramp form a group having the same angular offset. This makes it possible to obtain the same effect when driving forwards or in reverse (the ramps that are respectively upward and downward when in forward drive become respectively downward ramps and upward ramps when in reverse).

In a $2^4$ sequence, "position 4" (which, in this example, is the value chosen for the offset index) is repeated in groups of 15 successive states, the 16th state being identical to the first. The particular data found in position 4 associated with states 1 to 15 is of relevance and is illustrated in Table 2 below:

TABLE 2

| State | Piston | Position 1 | Position 2 | Position 3 | Position 4 | Offset |
|---|---|---|---|---|---|---|
| 1 | 1 | 0 | 0 | 0 | 1 | + |
| 2 | 2 | 1 | 0 | 0 | 0 | - |
| 3 | 3 | 0 | 1 | 0 | 0 | - |
| 4 | 4 | 0 | 0 | 1 | 0 | - |
| 5 | 5 | 1 | 0 | 0 | 1 | + |
| 6 | 6 | 1 | 1 | 0 | 0 | - |
| 7 | 7 | 0 | 1 | 1 | 0 | - |
| 8 | 8 | 1 | 0 | 1 | 1 | + |
| 9 | 9 | 0 | 1 | 0 | 1 | + |
| 10 | 10 | 1 | 0 | 1 | 0 | - |
| 11 | 11 | 1 | 1 | 0 | 1 | + |
| 12 | 12 | 1 | 1 | 1 | 0 | - |
| 13 | 13 | 1 | 1 | 1 | 1 | + |
| 14 | 14 | 0 | 1 | 1 | 1 | + |
| 15 | 15 | 0 | 0 | 1 | 1 | + |
| 1 | 16 | 0 | 0 | 0 | 1 | + |

As indicated above, the connections between the communication orifices and the main ducts of the machine are closed during the isolation stages. Thus, at the start of an isolation stage, the connection of the communication orifice in question to one of the main ducts has just closed, while, at the end of an isolation stage, the connection of the communication orifice in question to the other of the main ducts is about to open. To a certain extent, and in particular if it is large, the offset between the isolation stages can cause head loss at the time when the connection of the communication orifice in question to one of the main ducts opens. Such head loss can affect the speed of rotation of the rotor of the hydraulic machine. Taking the example of a hydraulic machine in which all of the cam lobes are identical and free of any offset (e.g. by having all of the communication orifices distributed uniformly relative to one another and, for a distributor of the hydraulic type, in which all of the distribution orifices are analogous and centered relative to the bisectors of the corresponding cam ramps), the offsetting of the invention can be seen as advancing or retarding the starts of the isolation stages for certain dead center arcs, in a given direction of rotation of the rotor of the machine. Considered in this given rotation direction, the retarding of certain isolation stages causes retarding of opening of the connection between the communication orifice in question and the main ducts of the machine, it being possible for such retarding to affect the maximum speed of rotation capacity of said rotor. Conversely, considered in the other direction of rotation of the rotor, said retarding results in advancing the isolation stage, which can thus advance the closing of the connection between certain communication orifices and the main ducts, without affecting the speed of rotation of the rotor in this other direction of rotation.

By choosing all the offsets to be in the same direction, i.e. considered in a given direction of rotation of the rotor of the machine, all of the offsets correspond to advancing the isolation stages, said offsets do not affect the speed of rotation of the rotor of the machine in that given direction of rotation. It is thus possible to choose deliberately to implement all of the offsets in the same direction for a machine having a preferred rotation direction, corresponding to forwards, for example, when the machine is a drive motor for driving a movement member for moving a vehicle, the direction of offset corresponding to advancing the isolation stages in this operating direction. Thus, it is during operation in the non-preferred direction, e.g. in reverse, that the offset can affect the maximum speed of the machine. These offsets may be distributed randomly or, for example, using a pseudo-random method of the PRBS type.

The concept of "offsetting in the same direction", which may be advancing or retarding, is to be considered in comparison with a machine not having any offsetting. For example, the offsetting can be considered in comparison with a machine in which all of the cam lobes are identical, in which the communication orifices are distributed uniformly, and in which the distribution orifices (for a hydraulic-type distributor) are analogous and centered relative to the ramps of the cam lobes (i.e. the centers of those orifices are aligned on the bisectors of said ramps). Compared with such a machine, for an analogous machine having offsets "in the same direction" implemented by the cam, some of the distribution orifices may remain centered on the bisectors of their respective cam ramps, while some others are all offset to the same sides of the bisectors of their respective cam ramps, i.e., for example, all offset in the clockwise rotation direction. The term "analogous machine" is used above to mean a machine that is entirely identical except as regards the offsetting.

Optionally, the starts or ends of at least three isolation stages that occur while the pistons mounted in the various cylinders are bearing on the same dead center arcs are at angular positions that are different and thus have angular offsets relative to one another, the values of these angular offsets between said isolation stages being different; e.g. said values may increase when the communication orifices of said various cylinders are considered in succession in a given rotation direction.

From the point of view of manufacturing the machine, this is a simple manner of implementing the offsetting, by doing it "progressively" from one isolation stage to another.

Optionally, the edges of at least some of the communication orifices are provided with notches.

Notches may be formed by arrangements of the edges of the distribution orifices and/or of the communication orifices, e.g. as described in PCT Applications WO 03/056171 and WO 03/056172.

Optionally, the pistons comprise at least one group of affiliated pistons for which, during a cycle of relative rotation between the cylinder block and the cam, there is at least one simultaneous situation during which said affiliated pistons co-operate with the identical cam lobes and find themselves, throughout their co-operation with said identical cam lobes, in identical positions relative to said cam lobes; and, for each of said identical cam lobes, the angular positions of the starts and of the ends of the isolation stages relative to the dead center arcs of said lobes that are associated with said isolation stages are identical. The affiliated pistons of the group(s) in question are then affiliated pistons without any offset.

The affiliated pistons are pistons that, by co-operating with the cam, deliver the same force at the same time. In general, it is desirable for such forces to balance out, i.e. for the resultant of the forces exerted radially by the pistons on the cam to be zero, so as not to create any unwanted forces transversely to the axis of the hydraulic machine. Such unwanted forces can also be a source of vibration, of jolts in torque, and of noise. Choosing the offsets to be the same for the affiliated pistons makes it possible to minimize the unwanted forces, by, as it were, synchronizing the sequences of opening and closing the communication orifices of their cylinders.

With reference to above-described Tables 1 and 2, some examples are given for offset sequences, in particular for piston offsetting. When the machine has one or more groups of affiliated pistons as defined above, it is possible to apply the offset sequences presented in the tables, but while leaving out the affiliated pistons in the numbering of successive pistons, except for the first affiliated piston, i.e. by giving each of the mutually affiliated pistons the same number as the number of that one of the affiliated pistons that comes first in the numbering of the pistons.

Conversely, for at least two affiliated pistons as defined above, it is possible to choose that, for each of said identical cam lobes, the angular positions of the starts and of the ends of the isolation stages relative to the dead center arcs of said lobes associated with said isolation stages are offset. The affiliated pistons of the group(s) in question are then affiliated pistons with offsetting.

This makes it possible to share among them the switchover energy on opening or closing the connections between the cylinders in which the affiliated pistons slide and the main ducts. This can make it possible to limit jolting during the switchovers. For a plurality of affiliated pistons, it is thus possible to implement successive switchovers of those pistons "in bursts". In order to prevent these offsets from being sources of large unwanted forces, it may be advantageous for them to be small, e.g. by being less than $1/5^{th}$ or indeed $1/10^{th}$ of the angle covered by the dead center in question. To obtain the burst effect for the various switchovers, the offset between the various affiliated pistons may be non-random.

One or more groups of affiliated pistons without offsetting may co-exist with one or more groups of affiliated pistons with offsetting.

For example, as described below, the hydraulic machine may have a plurality of cylinder capacities. It can then be analyzed as being a machine comprising a plurality of elementary machines which are all active in large cylinder capacity mode, while only one or other of the elementary machines is active in small cylinder capacity mode.

Each of these elementary machines or "sub-machines" preferably are preferably homokinetic. In a manner known per se, the sub-machines may be defined by the pistons they have, or indeed by the cam lobes to which they correspond. This is because, in a machine having radial pistons, it is possible to select the cylinder capacity by piston or by cam.

When the cylinder capacity is piston selected, each sub-machine is defined as a set of pistons that are connected in alternation to the feed and to the discharge when the sub-machine is activated, whereas when the sub-machine is deactivated, its pistons are put at the same pressure or they are retracted into their cylinders.

When the cylinder capacity is cam selected, each sub-machine corresponds to a set of cam lobes. The fluid distribution is such that:

- when a sub-machine is activated, its cylinders are connected to one or other of the main ducts, depending on whether their pistons are co-operating with the first ramp or with the second ramp of each of said lobes; and
- when a sub-machine is deactivated, its cylinders remain connected to the same enclosure (e.g. the same main duct or a reservoir without any significant pressure) while their pistons are co-operating both with the first ramp and also with the second ramp of each of said lobes.

When the cylinder capacity is piston selected, each sub-machine always has the same pistons. When the cylinder capacity is cam selected, each sub-machine always has the same cam lobes and, at each given instant, has the pistons that, at that instant, are co-operating with the same cam lobes.

Thus, in both situations, it is possible to define the pistons belonging to a sub-machine at each instant, regardless of whether or not they are always the same pistons.

The above-mentioned affiliated pistons may be pistons of the same sub-machine, or indeed pistons of different sub-machines.

In particular, it is possible to make a distinction between two possible categories of affiliated pistons, namely affiliated pistons from within the same sub-machine, and affiliated pistons from among different sub-machines. Optionally, for each of the identical cam lobes with which affiliated pistons from within the same sub-machine co-operate, the angular positions of the starts and ends of the isolation stages relative to the dead center arcs of the lobes that are associated with said isolation stages are identical, while, for each of the identical cam lobes with which affiliated pistons from among different sub-machines co-operate, the angular positions of the starts and ends of the isolation stages relative to the dead center arcs of said lobes that are associated with said isolation stages are offset.

Thus, the above-mentioned unwanted forces are avoided within the same sub-machine and, at the same time, the switchover energy is distributed between the affiliated pistons from among the different sub-machines.

BRIEF DESCRIPTION OF THE DRAWINGS

The invention can be well understood and its advantages appear more clearly on reading the following detailed description of embodiments that are shown by way of non-limiting example.

The description refers to the accompanying drawings, in which.

DESCRIPTION OF THE INVENTION

Figure 1:
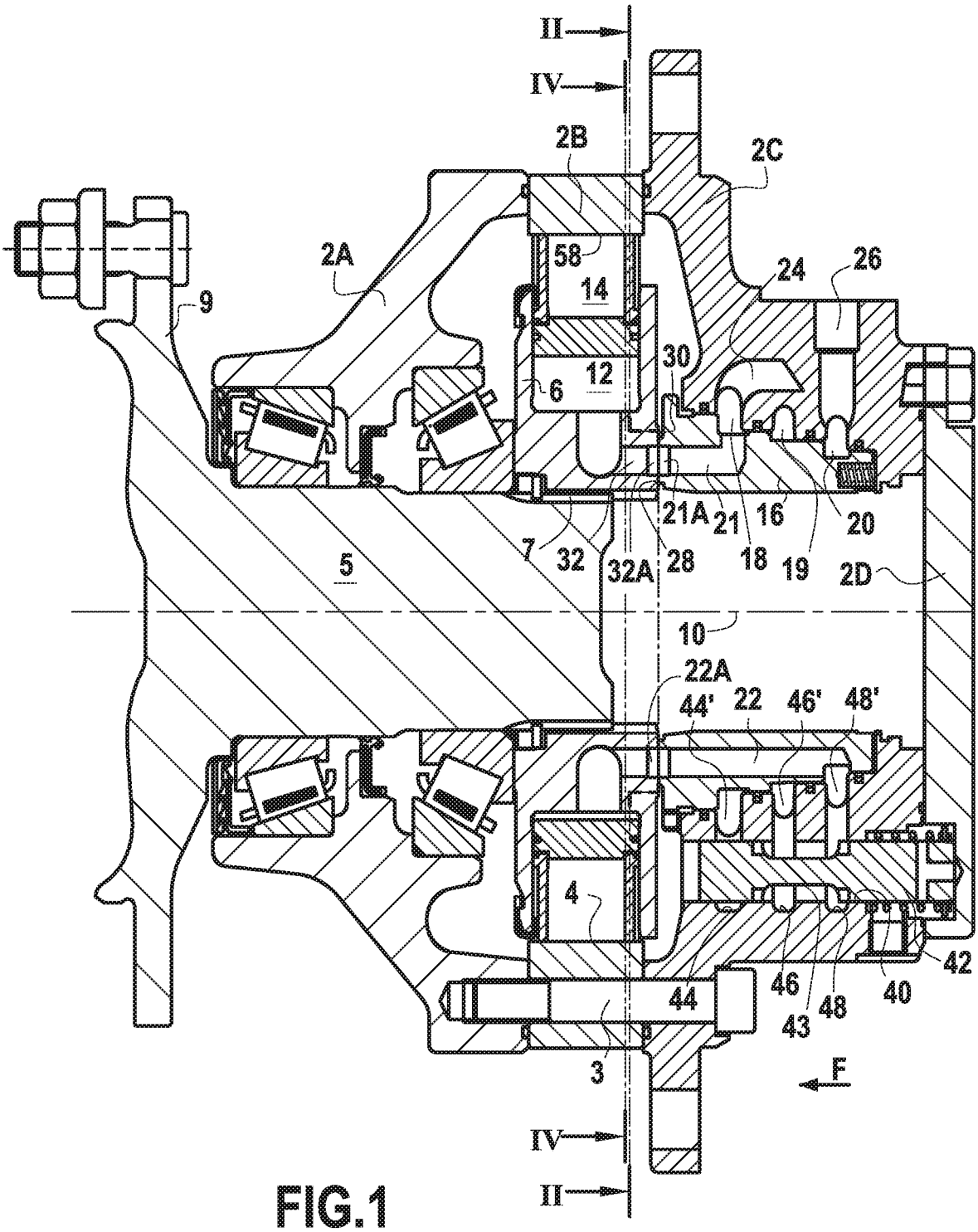
FIG. 1 is an axial section of a hydraulic machine having radial pistons, and to which the invention can be applied.

FIG. 1 shows a hydraulic machine, motor, or pump, comprising a stationary casing in three portions 2A, 2B, and 2C, assembled together by bolts 3.

Naturally, the invention is not limited to hydraulic machines having stationary casings, but rather it is also applicable to hydraulic machines having rotary casings and that are well known to the person skilled in the art.

The portion 2C of the casing is closed axially by a radial plate 2D that is also fastened by bolts. An undulating reaction cam 4 is formed on the portion 2B of the casing.

The machine further comprises a cylinder block 6 that is mounted to rotate about an axis 10 relative to the cam 4, and that has a plurality of radial cylinders 12 suitable for being fed with fluid under pressure, and inside which the radial pistons 14 are mounted to slide. The cylinder block is thus the rotor of the machine.

The cylinder block 6 rotates a shaft 5, which co-operates with it via fluting 7. This shaft carries an outlet flange 9.

The machine further comprises an internal fluid distributor 16 that is secured to the casing so that it is prevented from moving in rotation about the axis 10. Between the distributor 16 and the inside axial face of the portion 2C of the casing, distribution grooves are formed, respectively a first groove 18, a second groove 19, and a third groove 20. The distribution ducts of the distributor 16 are organized into a first group of ducts that, like the duct 21, are all connected to the groove 18, a second group of ducts (not shown) that are connected to the groove 10, and a third group of ducts that, like the duct 22, are connected to the groove 20. The first groove 18 is connected to a first main duct 24 to which all of the distribution orifices of the distribution ducts of the first group, such as the orifice 21A, are thus connected. The third groove 20 is connected to a second main duct 26 to which all of the distribution orifices of the distribution ducts of the third group, such as the orifice 22A of the duct 22, are thus connected.

Depending on the direction of rotation of the rotor (in this example, the cylinder block) of the machine, the main ducts 24 and 26 are respectively a fluid discharge duct and a fluid feed duct, or vice versa.

The distribution ducts open out in a distribution face 28 of the distributor 16, which face bears against a communication face 30 of the cylinder block, these two faces being perpendicular to the axis 10. Each cylinder 12 has a cylinder duct 32 that opens out in said communication face so that, while the cylinder block and the cam are rotating relative to each other, the cylinder ducts come into communication in alternation with the distribution ducts of the various groups.

The machine of FIG. 1 further comprises a cylinder capacity selector device that, in this example, comprises a bore 40 that extends axially in the portion 2C of the casing and in which an axially movable selector slide 42 is disposed. The bore 40 is provided with three communication ports, respectively 44, 46, and 48, which are connected to respective one of the grooves 18, 19, and 20, via connection ducts, respectively 44', 46', and 48'. The slide 42 is mounted to move between two end positions inside the bore 40, in which positions it causes the ports 44 and 46 or the ports 46 and 48 to communicate via its groove 43.

Figure 2:
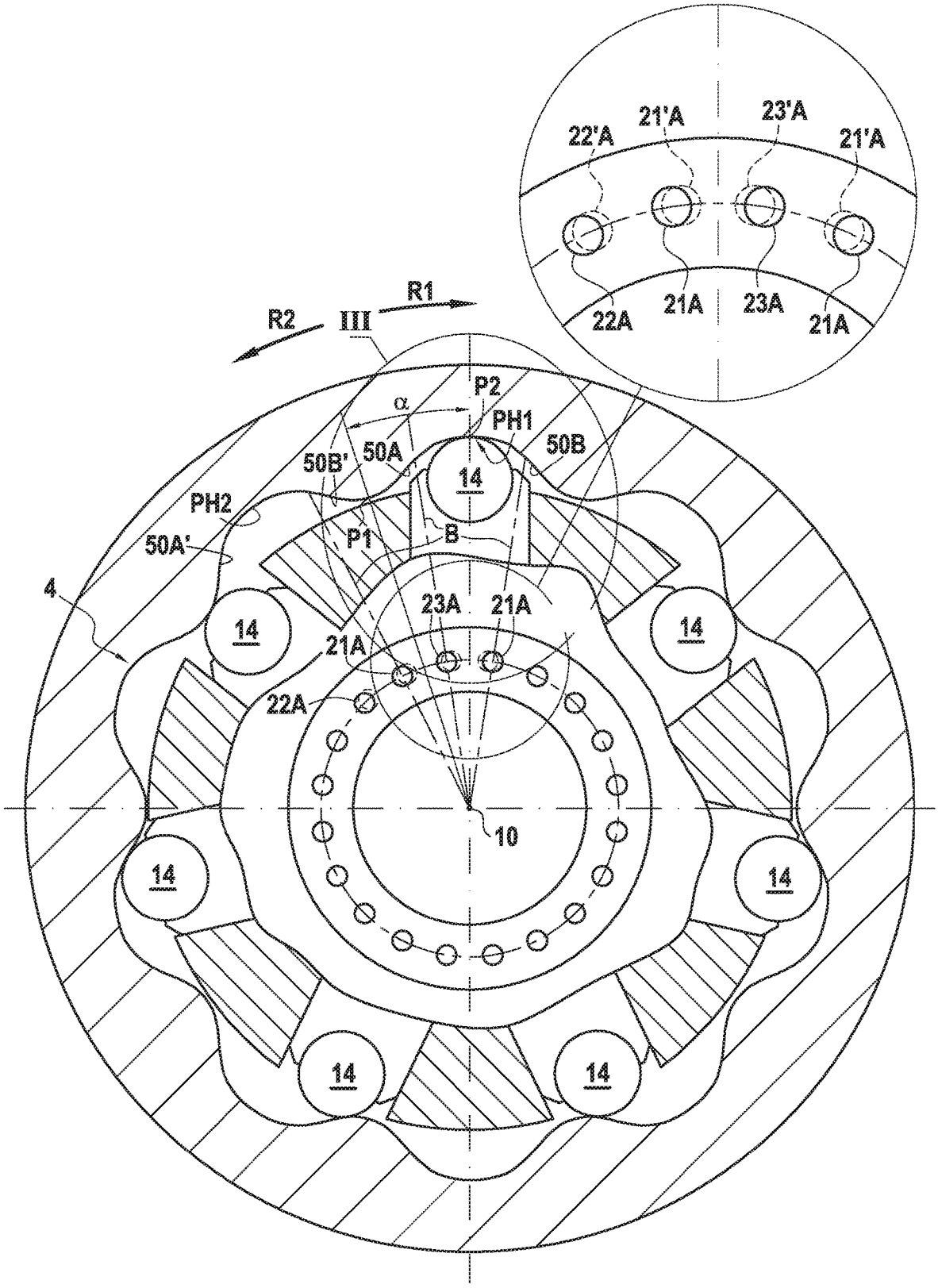
FIG. 2 is a view in section on broken line II-II of FIG. 1.

The radial section view of FIG. 2 is a view on broken line II-II of FIG. 1 that, in its portions distant from the axis 10, passes through the cylinder block, and that, in its portion close to the axis 10, passes through the distribution face 28 of the distributor 16. Thus, the positions of the pistons 14 relative to the cam 4 and the distribution orifices can be seen in this section view.

For example, as shown in FIG. 2, the distribution orifices, considered successively in the direction of relative rotation of the cylinder block and of the distributor, comprise a pair of orifices 21A, 23A connected to respective ones of the grooves 18 and 19, and a pair of orifices 21A, 22A connected to respective ones of the grooves 18 and 20. When the selector 42 is in the position shown in FIG. 1, both of the grooves 19 and 20 communicate with the fluid feed. It can be understood that, while the cylinder block and the distributor are rotating relative to each other, a communication orifice 32A is successively put at the high pressure and at the low pressure by communicating with the orifices of the two above-mentioned pairs. Conversely, when the selector 42 is moved in the direction indicated by arrow F in such a manner as to cause the grooves 18 and 19 to communicate with each other, then the two distribution orifices 21A, 23A of the first above-mentioned pair are both at the same pressure. That pair is thus inactivated because, when a communication orifice goes from one of the distribution orifices of said pair to the other of its distribution orifices, the pressure in the cylinder duct connected to said communication orifice does not change. Conversely, the following pair is active, because a communication orifice communicating with respective ones of the two orifices 21A, 22A of said pair is placed successively at the high pressure and at the low pressure.

The situation shown in FIG. 1 is thus a large cylinder capacity situation, while the situation in which the selector 42 is moved in the direction indicated by arrow F to cause the grooves 18 and 19 to communicate with each other is a small cylinder capacity situation. In such a situation, the pairs of orifices 21A and 23A are inactive, while the pairs of orifices 21A and 22A are active.

Figure 3:
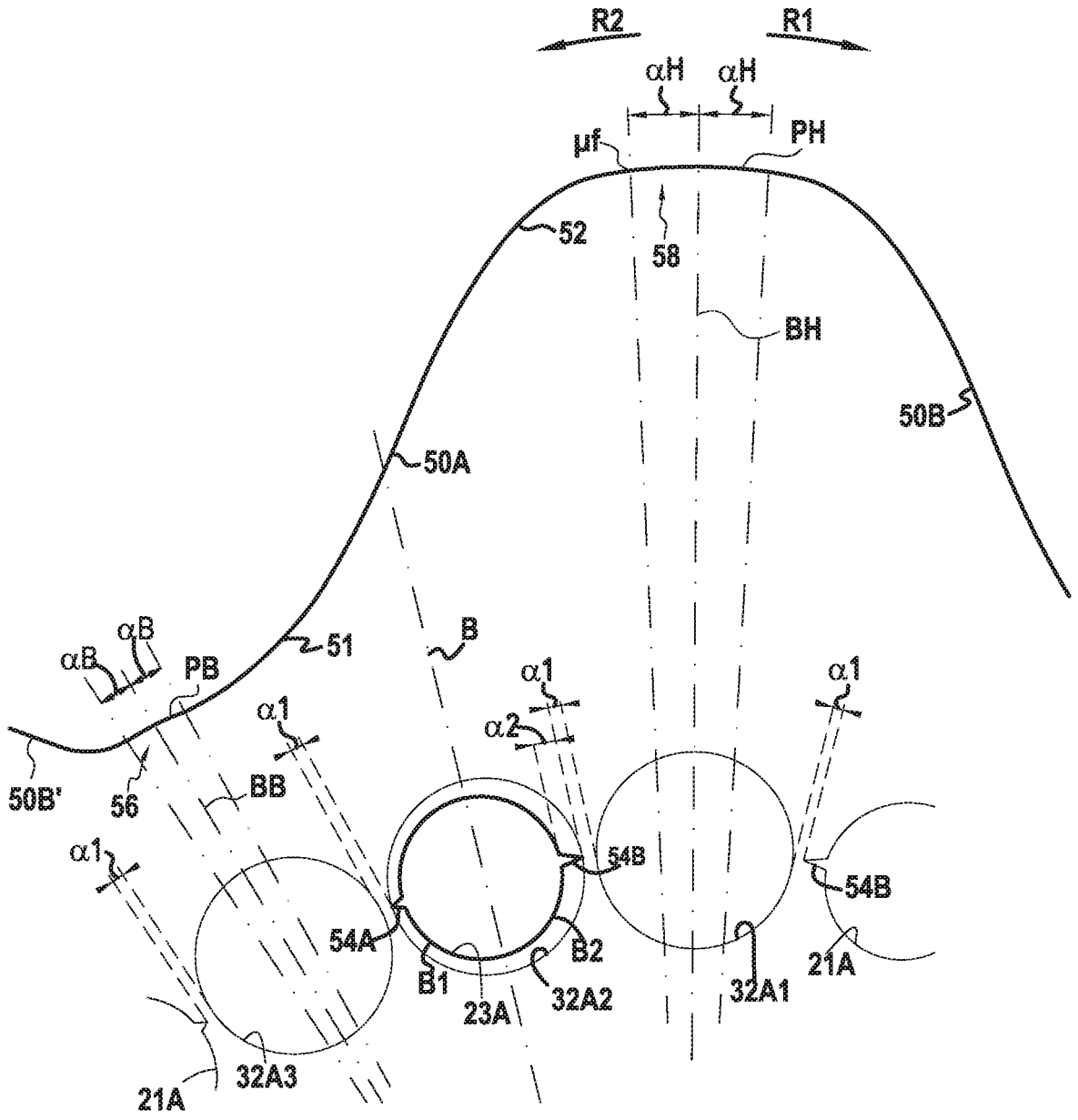
FIG. 3 is an enlargement of zone III of FIG. 2, showing the relative positions of a communication orifice and of a distribution orifice while the cylinder block and the distributor are rotating relative to each other.

When the cylinder block is rotating relative to the distributor in the rotation direction R1 indicated in FIG. 3, the portions B1 of the edges of the distribution orifices constitute leading portions, via which a communication orifice starts being put into communication with a distribution orifice, while the portions B2 of the edges of the distribution orifices constitute separation portions, via which the communication ceases. Naturally, when the relative rotation is taking place in the opposite direction R2, it is the portions B2 that constitute the leading portions and the portions B1 that constitute the separation portions.

Insofar as the cam and the distributor are constrained not to rotate relative to each other, the position of each distribution orifice relative to the lobes of the cam is fixed.

Each lobe of the cam 4 is provided with two ramps 50A and 50B, each of which has a convex region and a concave region.

Considered in the rotation direction R1, the ramp 50A is an upward ramp and the ramp 50B is a downward ramp, the cylinders being connected to the fluid feed when their pistons co-operate with an upward ramp, and being connected to the fluid discharge when their pistons co-operate with a downward ramp. FIG. 3 shows one of these ramps 50A, the convex region of which that is closer to the axis of rotation 10 is designated by reference 51, and the concave region of which that is further away from said axis is designated by reference 52.

A distribution orifice is affiliated with each ramp of the cam. An angular correspondence therefore exists between each distribution orifice and a ramp of the cam. Although the distribution orifices are not in the same radial plane as the cam, FIGS. 2 and 3 show the angular correspondence between the distribution orifices 23A and the ramp 50 of the cam. In this example, the distribution orifices shown in FIG. 2 are circular and each of said orifices is centered on the bisector B of the ramp of the cam to which it corresponds, as shown for the ramps 50B, 50A' and 50B' and the corresponding distribution orifices 21A, 23A, and 21A. The bisector B of each ramp of the cam is the bisector of the angle $\alpha$ covered by the ramp between the bottom midpoint P1 between two adjacent lobes and the top midpoint P2 between the two ramps of the same lobe.

This configuration is the configuration of the distribution orifices in a machine of the above-mentioned type, in which the isolation stages are not offset or, at least, not offset by the cam.

For a clearer understanding of the notion of isolation stage, reference is made to FIG. 3. In this figure, in order to make the drawing clearer, it is out of proportion, with the communication and distribution orifices being shown closer to the cam than they really are. The distribution orifice 23A shown in this figure is, in this example, an orifice having notches 54A and 54B, respectively in its portion B1 and in its portion B2. Such notches are described in detail in PCT Patent Application WO 03/056172. Substantially, the orifice 23A is disposed so that it lies within a circle that passes through the ends of the notches and that has its center on the bisector B of the angle covered by the ramp 50A. Thus, in this example, the orifice 23A is "centered" on said bisector. In designing hydraulic machines having radial pistons, the distribution orifices may however be positioned otherwise, provided that the distributor is angularly positioned accordingly, because the cylinder ducts that connect the cylinders to the communication orifices of the cylinder block may have a variety of shapes. Thus, it is possible for a communication orifice not to be centered on the axis of the corresponding cylinder and, in such a situation, the distribution orifices that communicate in alternation with the communication orifices while the cylinder block and the cam are rotating relative to each other, may themselves then not be centered on the bisectors of the angles covered by the cam lobes. In general, when the positioning of a distribution orifice relative to a cam ramp is not offset, the communication area via which said distribution orifice communicates with a communication orifice, which is not offset either, is maximized (or the centers of the distribution and communication orifices in question coincide) when the bearing point on the cam, at which the piston that slides in the cylinder having that communication orifice bears, is on the bisector of the angle covered by said cam ramp.

By way of simplification, a description follows of offsetting of a distribution orifice, with a distribution orifice centered on the bisector of the corresponding cam lobe being taken as the reference distribution orifice.

FIG. 3 also enables the shaping of the cam lobes to be understood more clearly. The cam lobe that is shown in this figure comprises two ramps, 50A and 50B respectively forming a downward ramp and an upward ramp in the rotation direction R2. The two ramps are interconnected (in their zones further away from the axis of rotation of the machine) by a cam trough zone 58 that forms a top dead center arc PH. Over the entire length of this dead center arc, the distance between the surface of the lobe and the axis of rotation of the machine is substantially constant. As a result, a piston in contact with said arc remains at a constant distance from said axis of rotation and is therefore not urged to move radially. The figure shows the start of the upward ramp 50B' that is part of the following cam lobe, in the rotation direction R2. The downward ramp 50A is connected to said upward ramp 50B' via a cam crest zone 56 that forms a bottom dead center arc. Similarly, over the entire length of this dead center arc, the distance between the surface of the lobe and the axis of rotation of the machine is substantially constant, and the piston in contact with this zone is not urged to move radially. The cam crest zones (in which the bottom dead center arcs are situated) are the zones in which the radial distance from the cam to the axis of rotation is at its minimum, while the cam trough zones (in which the top dead center arcs are situated) are the zones in which the radial distance from the cam to the axis of rotation is at its maximum. In the above definition of the dead center arcs, it is considered that the distance between the surface of the cam lobe and the axis of rotation is "substantially" constant if, when a piston co-operates with a dead center arc, its radial stroke is zero or substantially zero, e.g. by being no more than 0.5% of the radial amplitude of the stroke of a piston while the cylinder block and the cam are rotating relative to each other.

FIG. 3 also shows the various positions of a communication orifice 32A relative to the distribution orifice 23A during the relative rotation of the cylinder block and of the distributor, as well as the distribution orifice 23A that corresponds to the ramp 50A. The beginnings of the distribution orifices 21A that correspond to the ramps 50A and 50B' are also shown.

Considering FIG. 3 from right to left, an explanation is given of how the machine operates at full cylinder capacity, for feeding in the rotation direction R2, the distribution orifices (such as the orifices 21A) corresponding to the upward ramps being connected to the feed and the distribution orifices (such as the orifice 23A) corresponding to the downward ramps being connected to the discharge.

With the cylinder block turning in the direction R2, the piston in question (the piston that slides in the cylinder for which the various positions, 32A1, 32A2, and 32A3, of the communication orifice 32A are shown in FIG. 3) is firstly in contact with the upward ramp 50B, while a connection stage is taking place in which the communication orifice is connected to the feed main duct, via the distribution orifice 21A that corresponds to said ramp.

Then, the piston comes into contact with the top dead center arc PH and a switchover stage then takes place during which the connection from the communication orifice 32A to the distribution orifice 21A is closed, and then during which an isolation stage takes place in which the communication orifice is isolated from any distribution orifice, and then during which the connection from the communication orifice 32A to the distribution orifice 23A that corresponds to the ramp 50A is opened.

Then, the piston is in contact with the downward ramp 50A during a connection stage in which the communication orifice is connected to the discharge main duct, via the distribution orifice 23A.

Then, the piston comes into contact with the bottom dead center arc PB and a new switchover stage then takes place during which the connection from the communication orifice 32A to the distribution orifice 23A is closed, and then during which an isolation stage takes place in which the communication orifice is isolated from any distribution orifice, and then during which the connection from the communication orifice 32A to the distribution orifice 21A that corresponds to the upward ramp 50B' of the following lobe is opened.

More precisely, when the communication orifice 32A is in the position 32A1, the piston is in contact with the top dead center arc PH and this communication orifice is isolated from any distribution orifice; this is then during the isolation stage. It can be seen that, in this position, the orifice 32A is separated from the tip of the notch 54B of the orifice 23A by an angular distance $\alpha 1$, e.g. of about 1°, and that it is also separated from the notch 54B of the preceding distribution orifice 21A, in this example by the same angular distance $\alpha 1$. While the cylinder block is rotating relative to the distributor in the direction R2, the communication orifice 32A gradually comes to cover the distribution orifice 23A, starting with its notch 54B. In this example, once it fully covers the orifice 23A, the communication orifice is in its position 32A2 and its outline forms a circle that passes through the ends of the notches and that has its center on the bisector B of the angle covered by the ramp 50A.

While the rotation in the direction R2 continues, the communication sectional area decreases and the communication orifice ultimately leaves the separation portion B1 of the distribution orifice 23A via its notch 54A.

With the rotation continuing, the communication orifice reaches a position 32A3 in which it no longer communicates with any distribution orifice 23A, by being separated from said distribution orifice 23A and from the following distribution orifice in the rotation direction R2 by angular distances $\alpha 1$.

In FIG. 3, the top dead center arc PH covers an angular range $\alpha H$ on either side of its bisector BH (it thus covers an angle equal to $2\alpha H$ in all). Similarly, the bottom dead center arc PB covers an angular range $\alpha B$ on either side of its bisector BB (it thus covers an angle equal to $2\alpha B$ in all).

Figure 4:
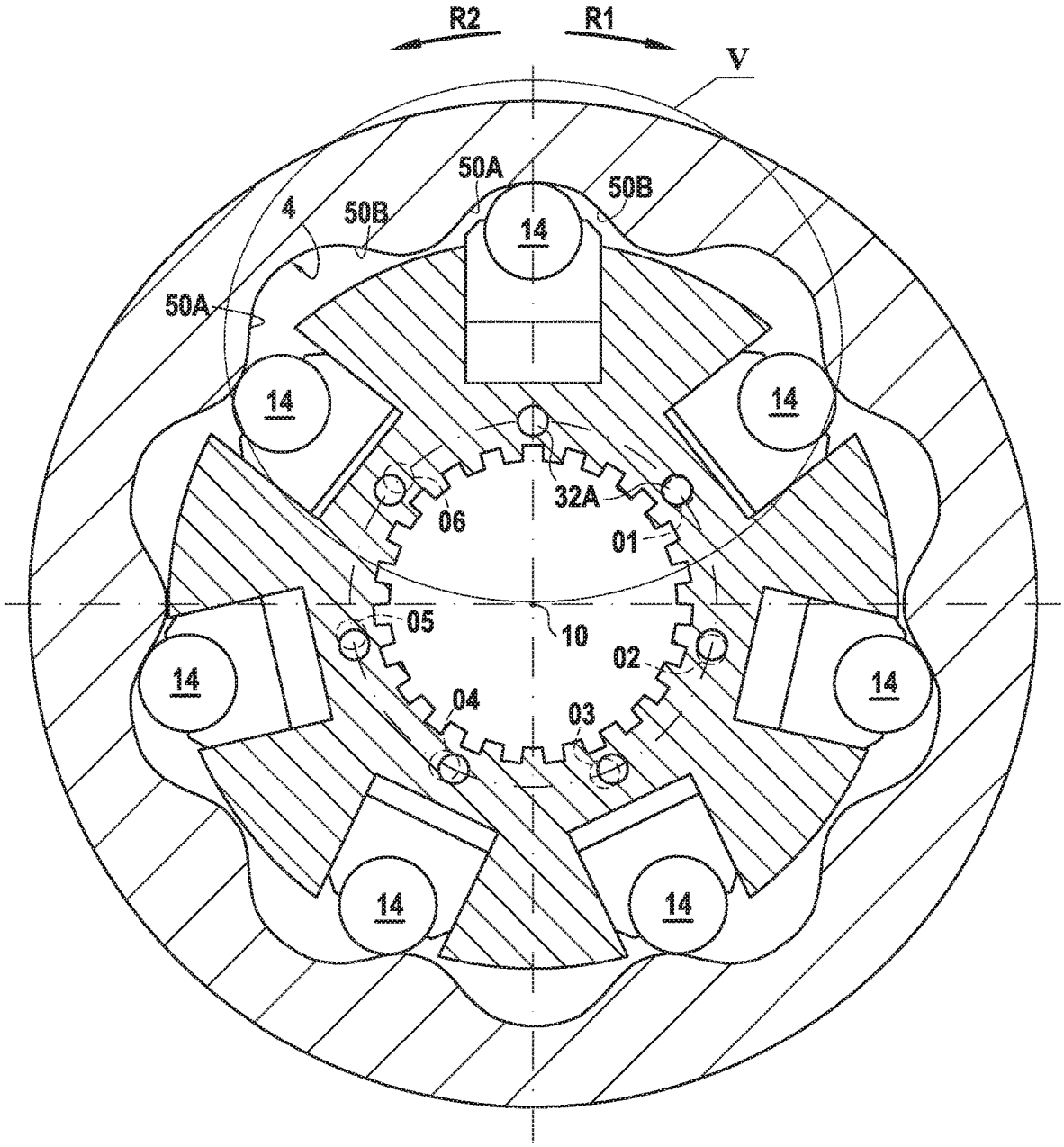
FIG. 4 is a view in section on line IV-IV of FIG. 1.

FIG. 4 is an axial section view through the cylinder block of the machine. The positions of the communication orifices 32A can be seen. In this example, each orifice is centered on the axis of the cylinder for which it constitutes the communication orifice. This is the simplest configuration. However, as indicated above, communication orifices may be offset relative to the axes of their respective cylinders. In this example, the various communication orifices 32A are spaced apart uniformly, in correspondence with the angular spacing between the axes of the cylinders. In the example shown in FIG. 4, the communication orifices 32A are of circular cross-section.

Figure 5:
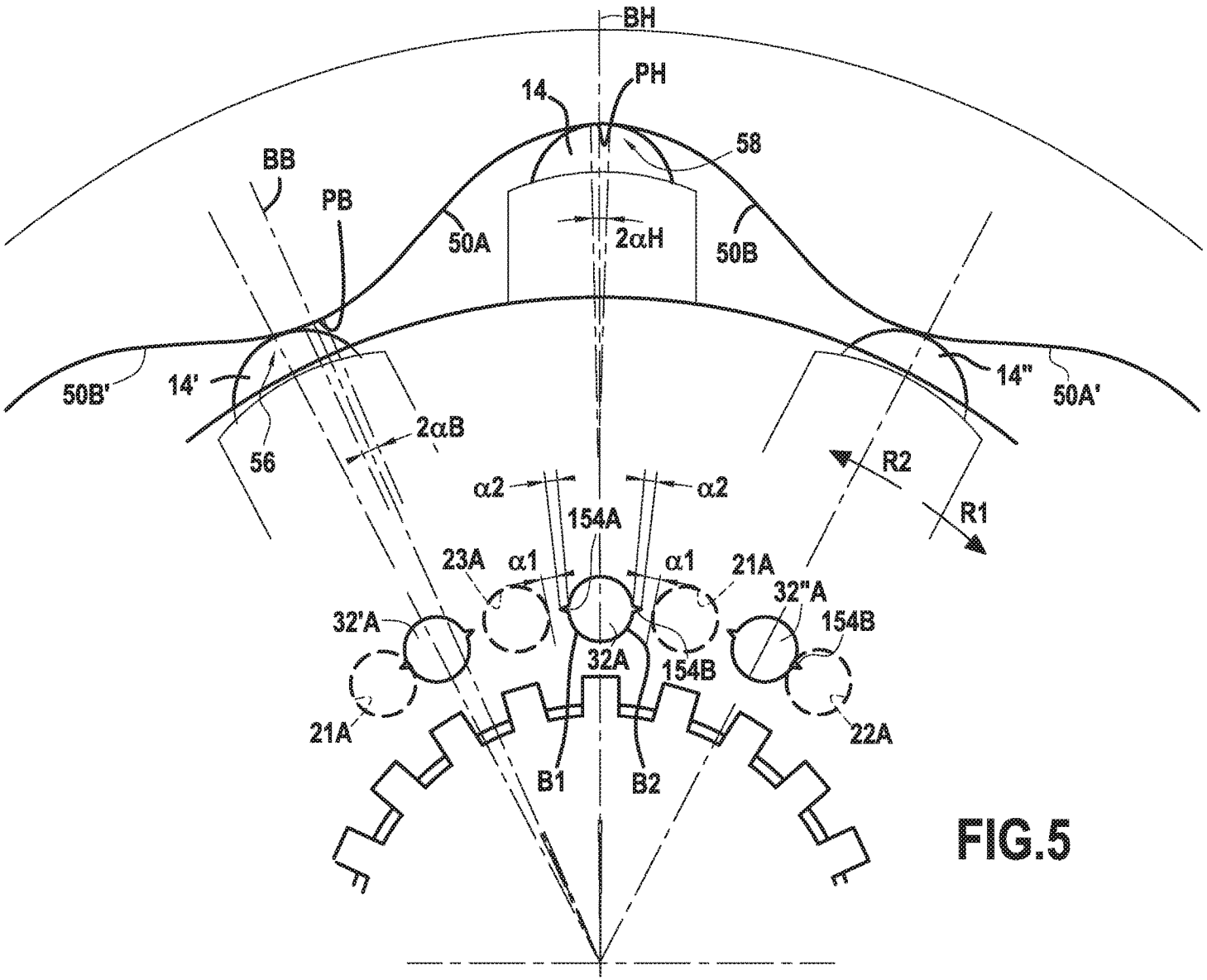
FIG. 5 is an enlargement of zone V of FIG. 4, showing, in addition, a variant embodiment.

In the variant shown in FIG. 5, the communication orifices 32A have leading portions and trailing portions provided with notches, respectively 154A and 154B. These orifices may be of the shape described in PCT Application WO 03/056171. FIG. 5 shows the positions relative to the cam of three pistons, respectively 14, 14', and 14". The piston 14 is in the isolation stage, it is in contact with the top dead center and it can be seen that its communication orifice 32 is isolated from any distribution orifice, over an angular range α1, on either side. In addition, each of the notches 154A and 154B in the edges of said orifice covers an angular range a2. Conversely, when the cylinder block is rotating in the direction R2, the piston 14' is starting to approach the upward ramp 50B'. It can be seen that the communication between its communication orifice 32'A and a distribution orifice 21A is starting to take place. This piston 14' has just left the isolation stage of the bottom dead center PB, in which stage its communication orifice was isolated from the distribution orifices 21A and 23B. As for the piston 14", it is reaching the bottom of a downward ramp 50A', and its communication orifice 32"A is communicating only via its notch 154B with the distribution orifice 22A. In FIG. 5, the distribution orifices 21A, 22A, and 23A are indicated in dashed lines, because they are not in the plane of this figure.

Figure 6:
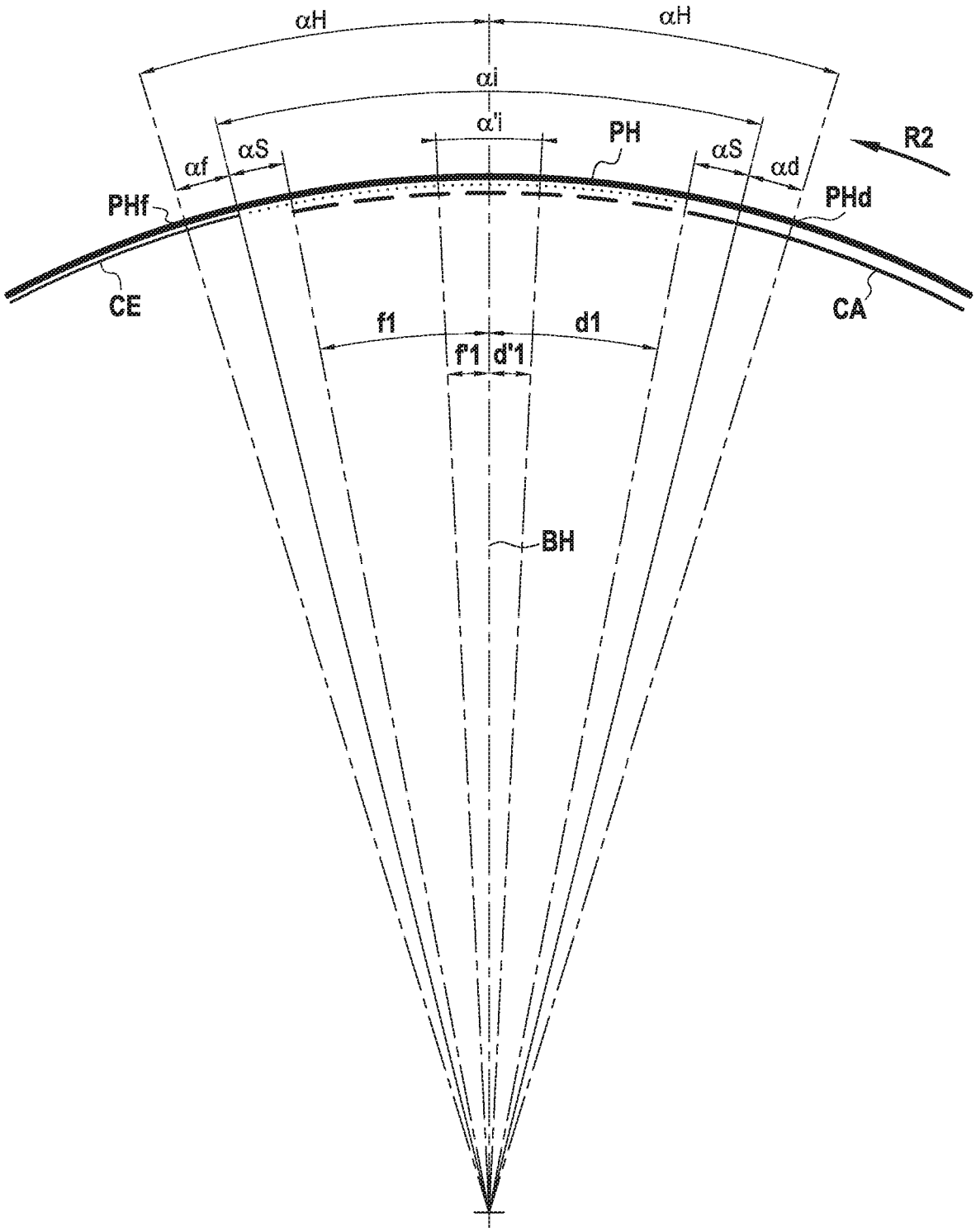
FIG. 6 shows, for a top dead center arc, the various angular ranges concerned by a switchover stage.

FIG. 6 diagrammatically shows a top dead center PH, which covers an angular sector αH on either side of its bisector BH. Considering that the cylinder block is rotating in the direction R2 relative to the cam, and starting from the right in FIG. 6, a thick line is used to show the stroke CA of contact between the piston and the cam, during which stroke the communication duct of the cylinder in which the piston slides is connected to the fluid feed. It can be seen that the fluid feed ceases while the piston is already in the dead center arc PH, after having traveled through an angular sector ad after the start PHd of the dead center arc. Then, when the rotation continues in the direction R2, the piston ceases to be connected to the feed and is not yet connected to the discharge, until it reaches a little before the end PHf of the dead center arc PH and until it is then connected to the fluid discharge. The connection between the communication orifice and the fluid discharge takes place while the piston is traveling along the stroke CE indicated as a fine line. The communication with the fluid discharge starts with an angular difference of relative to the end of the dead center arc PHf. Thus, the angular range αi available for the isolation stage corresponds to the total angular range of the dead center arc 2αH, minus the angular difference ad between the start of the isolation stage and the start of the dead center arc PH, and minus the angular difference of between the end of the isolation stage and the end PHf of the dead center arc. The angular differences ad and of are at least equal to $1/20^{th}$, and preferably at least equal to $1/10^{th}$ of the total angle 2αH covered by the dead center arc. These angular differences procure safety times, making it possible to avoid the communication with the fluid feed ceasing too early and to avoid the communication with the fluid discharge starting too late, in order to avoid cavitation and shock phenomena. Naturally, the same differences apply mutatis mutandis to the bottom dead center arcs, for which the communication with the discharge ceases with a slight angular difference relative to the start of the dead center arc, and the communication with the feed starts with a slight angular difference before the end of the dead center arc.

Thus, returning to FIG. 6, it can be observed that the isolation stage, during which the communication orifice is isolated from any distribution orifice, can take place over the angular stroke αi of the piston over the dead center arc PH. To avoid any short-circuit between the feed and the discharge, a safety range αS is also kept for the isolation stage so as to ensure that the connection is properly closed before the isolation stage, and that the connection is properly opened after the isolation stage. In conventional hydraulic machines, the isolation stages are centered relative to the bisectors BH of the cam lobes and cover, for example, the angular range αi or an angular range α'i that is slightly smaller, as indicated in FIG. 6. For the reasons indicated above, an angular range αi minus αS is available for enabling the isolation stage to take place in full safety. Thus, the isolation stage could start only while the piston is traveling over the stroke indicated by the dashed-line extension to the curve CA, or it could finish while the piston is traveling over the stroke indicated by the dotted-line extension to the stroke CE.

Thus, the angular range available for achieving the offset with relation to a dead center angle that may also be termed "maximum offset latitude" (Lmo) satisfies the condition (i):

$$\mathrm{Lmo} \leq 2\alpha H - \alpha d - \alpha f - \alpha S \qquad \text{(i)}$$

it being recalled that αi=2αH−αd−αf.

Naturally, a similar condition is valid for a bottom dead center arc, by replacing αH, which is the half angular range covered by a top dead center arc, with αB, which is the half angular range covered by a bottom dead center arc.

Figure 7A:
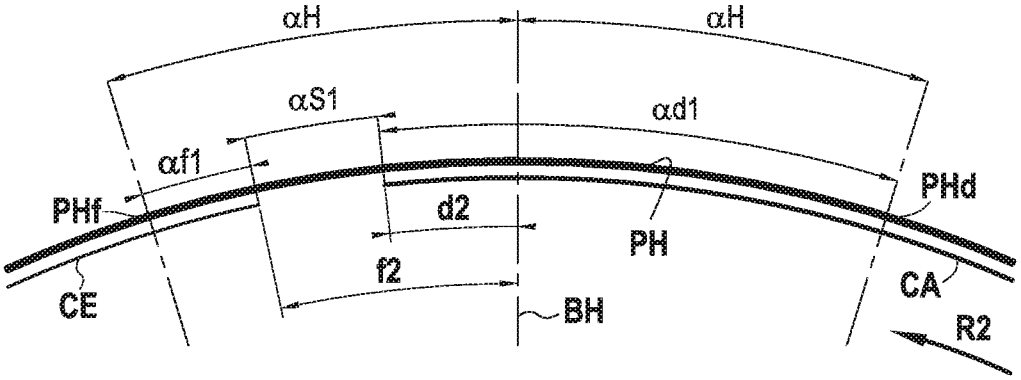
FIGS. 7A and 7B show the switchover stages for two top dead center arcs.
Figure 7B:
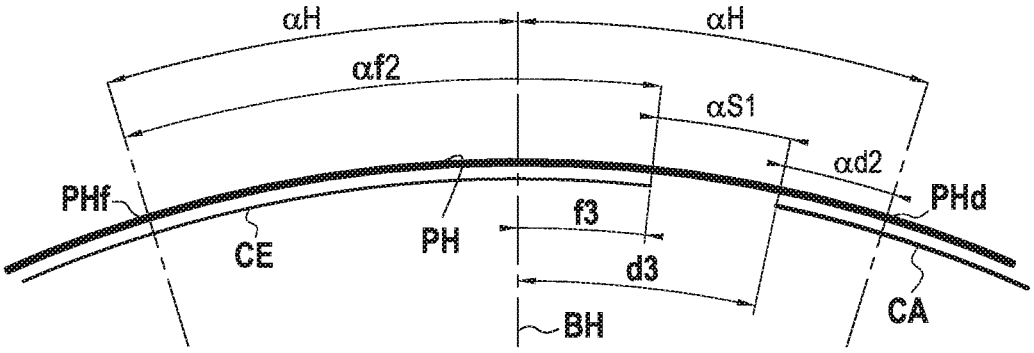

It is thus possible, in accordance with the invention, to offset the start and/or the end of the isolation stage, provided that said start and said end lie within the angular range αi minus αS. This is what is shown in FIGS. 7A and 7B. In FIG. 7A, for a first piston, the start of the isolation stage takes place once the piston has travelled over an angular stroke αd1 since the start PHd of the dead center arc PH, as shown by the uninterrupted-line curve CA. For the same piston, the isolation stage ceases while the piston is at an angular distance αf1 from the end PHf of the dead center arc, as shown by the curve CE.

In FIG. 7B, for the same piston of the same machine, it can be seen that the isolation stage starts while the piston is at an angular distance αd2 from the start PHd of the dead center arc, and that the isolation stage ends while the piston is still at an angular distance αf2 from the end PHf of the dead center arc PH. Thus, the first isolation stage shown in FIG. 7A and the second isolation stage shown in FIG. 7B are offset relative to each other. In addition, if the piston for which the isolation stage is shown in FIG. 6 belongs to the same motor, it can be seen that the three isolation stages have indeed been offset relative to one another.

As indicated above, the angular differences ad and of are optionally not less than $1/20^{th}$ of the angle 2αH or 2αB covered by the dead center arc in question. Similarly, the safety range αS corresponding to the minimum value of the angle covered by the isolation stage is optionally not less than $1/20^{th}$ of the angle 2αH or 2αB.

In the meaning of this description, the angular position of the start or of the end of an isolation stage relative to the dead center arc connected to that isolation stage is defined as being the angular difference between said start or said end and the bisector of the angle covered by the dead center arc connected to said isolation stage. With reference to FIG. 6, it can thus be seen that, for the isolation stage αi, the angular position of the start of the isolation stage is defined by the angle d1, while the angular position of the end of the isolation stage is defined by the angle f1. If the isolation stage of said piston corresponds to the angle α'1, then the angular position of the start of the isolation stage is defined by the angle d'1 and the end of this angular range is defined by the angle f'1. Conversely, in FIG. 7A, the angular position of the start of the isolation stage is defined by the angle d2, which is negative because the piston has then already gone beyond the bisector BH, and the angular position of the end of the isolation stage is defined by the angle f2. In the situation shown in FIG. 7B, the angular position of the start of the isolation stage is defined by the angle d3, and the angular position of the end of the isolation stage is defined by the angle f3, this angle being positive because the piston has not yet gone beyond the bisector BH. Thus, considering the pistons for which the isolation stages are shown in FIGS. 6, 7A, and 7B, the offsets between the starts and ends of the isolation stages for the various pistons are defined by the differences between the angles d1, d2, and d3, and between the angles f1, f2, and f3.

For example, three possible offset indices can be provided: −1, 0, and +1. The offset index 0 corresponds to synchronized pistons, e.g. all as shown in FIG. 6, while the indices +1 and −1 correspond to offsets in opposite directions, for an absolute offset value (measured as an angular range or as a length of arc), either with a retard in the start of the isolation stage, as shown in FIG. 7A, or with an advance, as shown in FIG. 7B. By comparing FIGS. 7A and 7B, this would correspond to having the same absolute values for the angles d2 and f3, and to having the same absolute values for the angles f2 and d3.

The offsets shown in FIGS. 6A, 7A, and 7B can be achieved by "cylinder" offsetting or by "cam" offsetting. For a "cylinder" offset, it can be considered that the cam lobe shown in these three figures is the same and that the offsets in the isolation stages are achieved by offsets in the communication orifices. For a "cam" offset, it can be considered that the three cam lobes are different, and that the isolation stages shown in the figures take place for the same piston, depending on which of the cam lobes it is co-operating with.

In order to obtain a cam offset, it is the distribution orifices that are offset relative to one another. Thus, in FIGS. 2 and 3, each of the distribution orifices is centered on the bisector of the corresponding ramp of a cam lobe. This applies to the distribution orifices shown in uninterrupted lines in FIG. 2. However, certain distribution orifices can be offset slightly, as indicated for the distribution orifices 22'A, 21'A, 23'A, and 21'A shown in dashed lines, these orifices corresponding to respective ones of the cam lobes 50A', 50B', 50A, and 50B. For example, considering, in FIG. 2, the two ramps 50B and 50B' at the ends of which respective ones of the dead center arcs PH1 and PH2 are defined, it can be seen that the distribution orifices 21'A corresponding to these two ramps are offset relative to each other, i.e. each of them is positioned differently relative to the bisector of the angle covered by the ramp in question. Similarly, the distribution orifices 22'A and 23'A corresponding to respective ones of the cam lobes 50A' and 50A are offset relative to each other. In this example, considering that "reference" other distribution orifices are in the positions shown in uninterrupted lines (centered on the bisectors of their respective corresponding cam lobes), there are only two offset values relative to these reference orifices, either in one direction (for the orifices 21'A and 23'A), or in the other direction (for the orifices 22'A and 23'A).

Naturally, for piston offsetting, depending on the number of pistons included in the machine, it is possible to have a higher or a lower number of offset values, and to assign the various values randomly to the various positions, or pseudo-randomly, e.g. by the PRBS method, or indeed incrementally, the pistons following one another in the rotation direction having offsets that increase, starting from a first piston, as shown in FIG. 4.

FIG. 4 is a view in section through the cylinder block of a hydraulic machine having radial pistons without any offset, the positions of the distribution ducts, as represented by their orifices 32A shown in uninterrupted lines in FIG. 4, not being offset relative to one another. In the same figure, dashed lines are used to show positions of communication orifices 32A that can make it possible to achieve cylinder offsetting. For example, the communication orifice 32A of one of the cylinders remains in the initial position, e.g. by being centered on the axis of the cylinder, while the following orifices are offset, in respective ones of the positions O1, O2, O3, O4, O5, and O6, for the six other cylinders. In this example, the offset is made in the same direction, i.e., relative to the cylinder axes, all of the offsets tend to shift the communication orifices to the same side of the axes. In this example, it can be seen that the offset increases going around the cylinder block in the direction R1. As a result, for the same dead center arc, the angular position of the start or of the end of the isolation stage is different depending on which piston is co-operating with the dead center arc.

Figure 8:
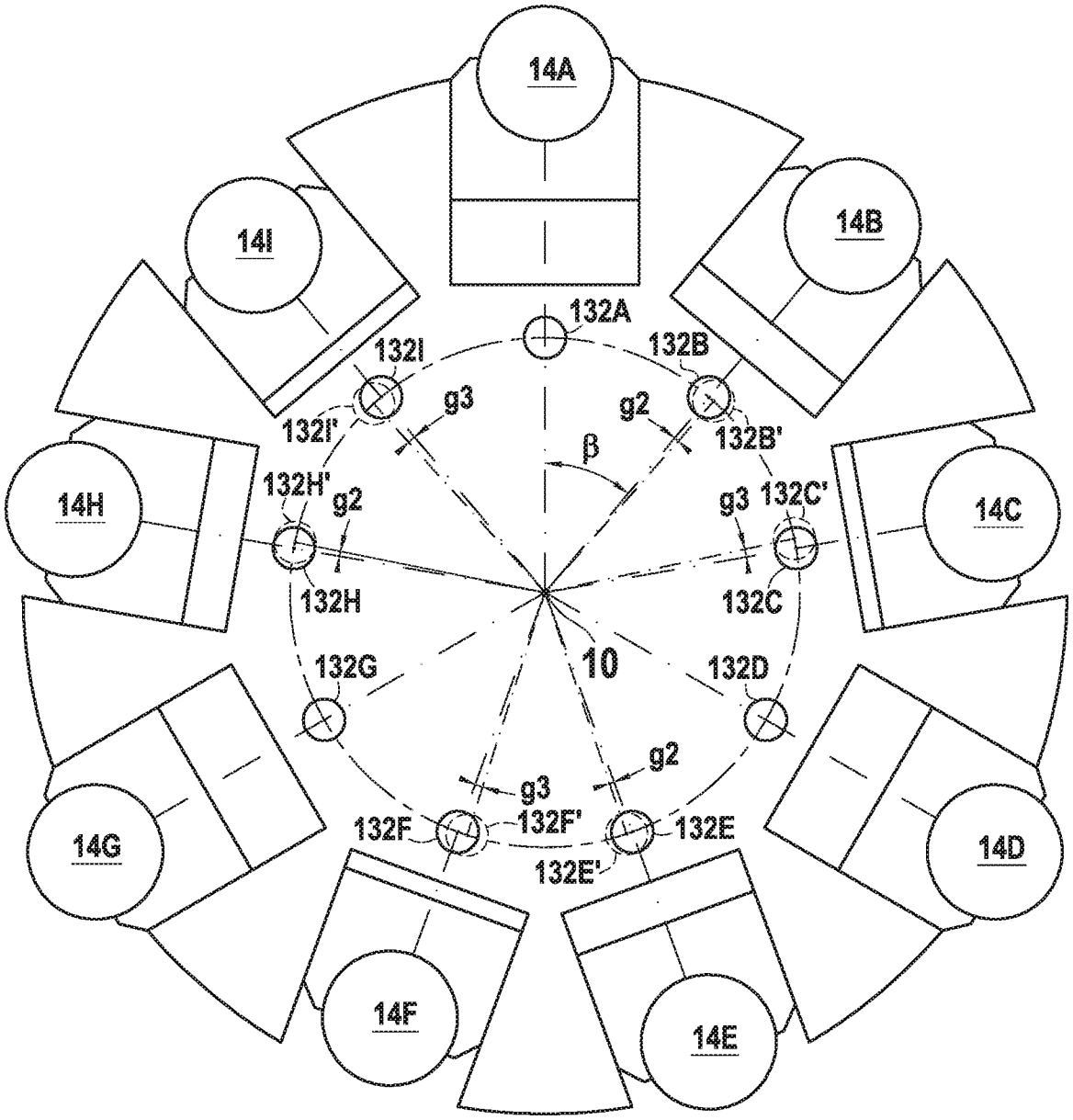
FIG. 8 shows, in a variant, the cylinder block of a machine of the invention.

FIG. 8 diagrammatically shows the positions of the communication orifices 132A to 132I of the cylinder block in a machine of the invention. FIG. 8 only shows the positions of these orifices and shows the corresponding cylinders and their pistons only diagrammatically. In a conventional machine, the orifices 132A to 132I are spaced apart uniformly, the angles β measured between the radii passing through the centers of the orifices being identical between all of the adjacent orifices.

As indicated above, each communication orifice is the communication orifice of a cylinder in which a piston slides, so that each communication orifice corresponds to a piston. In this machine, pistons are said to be "affiliated". During a cycle of relative rotation of the cylinder block and of the cam, such affiliated pistons all find themselves in the same position relative to the cam lobes with which they are co-operating at any given time. This makes it possible to balance the radial forces exerted on the cam. For example, in this example, nine pistons corresponding to the nine communication orifices are distributed into three groups of affiliated pistons, a first group comprising the pistons 14A, 14D, and 14G corresponding to the orifices 132A, 132D, and 132G, the second group comprising the pistons 14B, 14E, and 14H corresponding to the orifices 132B, 132E, and 132H, and the third group comprising the pistons 14C, 14F, and 14I corresponding to the orifices 132C, 132F, and 132I.

For example, these pistons can remain affiliated throughout a rotation cycle, i.e. throughout the cycle each of them remains in the same relative position relative to the cam lobe with which it is co-operating at any given time, which assumes that all of the cam lobes are identical. It is also possible to have affiliated pistons that vary from one cam lobe to another, e.g. at a given time, three affiliated pistons co-operating with analogous cam lobes are all in the same relative position relative to the cam lobes in question, and then, when they go into the following cam lobe, other pistons are affiliated.

The machine diagrammatically shown in FIG. 8 may be modified to be implemented in accordance with the invention, by implementing cylinder offsetting. For example, the communication orifices of the cylinders of the pistons of the first group remain in unchanged positions, still centered on the axes of the corresponding pistons. Conversely, the communication orifices 132B', 132E', and 132H' of the cylinders in which the pistons of the second group slide are all offset, as indicated in dashed lines, the angles g2 of the offsetting of their centers relative to the centers of the initial orifices all being identical. Similarly, the communication orifices 132C', 132F' and 132I' of the cylinders in which the pistons of the third group slide are all offset in identical manner, the angles g3 of the offsetting of the centers of the orifices all being identical.

Thus, if, in parallel, no cam offset is implemented, the affiliated pistons have the same angular positions for starting and ending the isolation stages relative to the dead center arcs of the lobes associated with the isolation stages, throughout their co-operation with the cam. As indicated above, the affiliated pistons may be identified as such only from the point of view of them co-operating with a group of identical cam lobes during a portion of the rotation cycle, and, in such a situation, what is described above makes it possible to ensure that the starts and the ends of the isolation stages are the same when the affiliated pistons co-operate with the dead center arcs of said identical cam lobes.

The invention claimed is:

1. A hydraulic machine having radial pistons and comprising a cam and a cylinder block that rotate relative to each other about an axis of rotation, the machine having a first and a second main duct respectively for feed and discharge or discharge and feed of hydraulic fluid, the cylinder block having multiple radial cylinders connected to communication orifices of the cylinder block, there being a communication orifice for each cylinder of the multiple of cylinders, the radial pistons mounted to slide in the cylinders and co-operating with the cam, said cam having a plurality of lobes, each lobe having two ramps, each ramp of each lobe extending between a top dead center arc and a bottom dead center arc, the machine further comprising a fluid distributor for connecting the communication orifices to the first or the second main duct in sequences, the fluid distributor being constrained not to rotate relative to the cam, each sequence of connecting any one particular communication orifice to the first or second main duct comprising a first connection stage during which the particular communication orifice is connected to the first main duct and a second connection stage during which said particular communication orifice is connected to the second main duct, the first and second connection stages being separated by a switchover stage, the switchover stage comprising, in succession, for each cylinder, closing a connection of a selected communication orifice to one of the first and second main ducts, isolating in an isolation stage the selected communication orifice from the two main ducts, thereby defining multiple isolation stages with one isolation stage associated with each cylinder, and opening a connection of the selected communication orifice to the other one of the first and second main ducts, wherein the selected communication orifice is the communication orifice of a particular cylinder, and each stage of the multiple isolation stages taking place while the piston mounted in the particular cylinder is bearing on a particular top dead center arc or bottom dead arc, which is defined as being the dead center arc that is associated with the isolation stage, an angular position of a start or of an end of any particular isolation stage relative to the particular dead center arc that is associated with said particular isolation stage being defined as being the angular difference between said start or said end and the bisector of the angle covered by said particular dead center arc that is associated with said particular isolation stage;

wherein an angular position of the start or the end of a first isolation stage of the multiple isolation stages relative to the dead center arc that is associated with the first isolation stage is different from an angular position of the start or the end of a second isolation stage of the multiple isolation stages relative to the dead center arc that is associated with said second isolation stage during one revolution cycle of the machine, and wherein the dead center arcs associated with said first isolation stage and said second isolation stage are both one of top dead center arcs and bottom dead center arcs.

2. The machine according to claim 1, wherein, there is an isolation stage associated with each particular switchover stage and for each particular switchover stage, the difference between the angular position of the start of the isolation stage of the particular switchover stage and the start of the dead center arc that is associated with said isolation stage of the particular switchover stage, and the difference between the angular position of the end of the isolation stage of the particular switchover stage and the end of said dead center arc that is associated with said isolation stage of the particular switchover stage is not less than $1/20^{th}$ of the angle covered by said dead center arc.

3. The machine according to claim 1, wherein, there is an isolation stage associated with each particular switchover stage and for each particular switchover stage, the length of an arc between the angular position of the start of the isolation stage of a particular switchover stage and the start of the dead center arc that is associated with said isolation stage of the particular switchover stage, and the length of arc between the angular position of the end of the isolation stage of the particular switchover stage and the end of said dead center arc that is associated with said isolation stage of the particular switchover stage are not less than 0.1 mm.

4. The machine according to claim 1, wherein an absolute value of the difference between the angular positions of the start or of the end of the first isolation stage and the second isolation stage is not less than $1/20^{th}$ of the angle covered by the smaller of the dead center arcs that are associated with the first isolation stage and the second isolation stage.

5. The machine according to claim 1, wherein the difference between angular positions of the start or of the end of the first isolation stage and the second isolation stages covers an arc having a length not less than 0.1 mm.

6. The machine according to claim 1, wherein the fluid distributor is provided with distribution orifices adapted to be connected to either one of the main ducts and for being successively in register with the communication orifices of the cylinder block while the cylinder block and the cam are rotating relative to each other, each distribution orifice corresponding to one of the ramps of the cam.

7. The machine according to claim 6, wherein the first isolation stage and the second isolation stage utilize the communication orifice of the same cylinder, the angular position of the start or of the end of the first isolation stage that takes place while the piston mounted in the same cylinder is bearing against a first dead center arc being offset relative to the angular position of the start or of the end of the second isolation stage that takes place while the piston mounted in said same cylinder is bearing against a second dead center arc different from the first dead center arc, and wherein, with the first and second dead center arcs being respectively situated at one end of a first ramp and at one end of a second ramp, the position of the distribution orifice corresponding to the first ramp and the position of the distribution orifice corresponding to the second ramp are at a first offset relative to each other, which positions are relative to the bisectors of the angles covered by the respective ramps.

8. The machine according to claim 7, wherein, with the first and second ramps being respectively ramps of a first cam lobe and of a second cam lobe, the position of the distribution orifice corresponding to the other ramp of the first cam lobe, and the position of the distribution orifice corresponding to the other ramp of the second cam lobe are, relative to each other, at the same offset as the first offset, which positions are relative to the bisectors of the angles covered by the respective other ramps.

9. The machine according to claim 1, wherein the first isolation stage and the second isolation stage utilize the communication orifice of the same cylinder, the angular position of the start or of the end of the first isolation stage that takes place while the piston mounted in the same cylinder is bearing against a first dead center arc being offset relative to the angular position of the start or of the end of the second isolation stage that takes place while the piston mounted in said same cylinder is bearing against a second dead center arc different from the first dead center arc.

10. The machine according to claim 1, wherein the first and second isolation stages utilize the same dead center arc, the angular position of the start or of the end of the first isolation stage that takes place while a piston mounted in a first cylinder of the multiple of cylinders is bearing against the same dead center arc being offset relative to the angular position of the start or of the end of the second isolation stage that takes place while the piston mounted in a second cylinder of the multiple of cylinders that is different from the first cylinder of the multiple of cylinders is bearing against said same dead center arc.

11. The machine according to claim 10, wherein the communication orifices of the first and second cylinders have different configurations relative to the respective axes of said first and second cylinders.

12. The machine according to claim 1, wherein the angular position of the start or of the end of a third isolation stage of the multiple isolation stage is different from the angular position of the start or of the end of the first and second isolation stages are different, with different values of at least one of parameters chosen from among the amplitude of the first, second and third isolation stages and the angular offsets of the positions of the starts or ends of the first, second and third isolation stages being distributed between said first, second and third isolation stages, the different values being fewer in number than the number of said first, second and third isolation stages.

13. The machine according to claim 1, wherein the angular position of the start or the end of the third isolation stage is different from the angular position of the start or of the end of the first and second isolation stages, so that the angular positions of the starts or the ends of said first, second and third isolation stages have angular offsets relative to each other, these angular offsets having the same absolute value and having different directions.

14. The machine according to claim 1, wherein, for the first and second isolation stages in which the angular positions of the starts or ends of strokes are different, the offsets are in the same direction.

15. The machine according to claim 1, wherein the angular positions of the starts or ends of the third isolation stage is different from the angular position of the start or of the end of the first and second isolation stages, said different angular positions of the starts or ends of said first, second and third isolation stages taking place while the pistons mounted in the various cylinders are bearing on the same dead center arc are different and thus have angular offsets relative to one another, the values of these angular offsets between said isolation stages being different.

16. The machine according to claim 1, wherein edges of at least some of the communication orifices are provided with notches.

17. The machine according to claim 1, wherein the pistons comprise at least one group of affiliated pistons for which, during a cycle of relative rotation of the cylinder block and of the cam, there is at least one simultaneous situation during which said affiliated pistons co-operate with identical cam lobes and throughout their co-operation with said identical cam lobes, in identical positions relative to said cam lobes, and wherein, for each of said identical cam lobes with which the affiliated pistons of said group co-operate, the angular positions of the starts and of the ends of each isolation stage relative to the dead center arcs of said lobes that are associated with each isolation stage are identical.

18. The machine according to claim 1, wherein the pistons comprise at least one group of affiliated pistons for which, during a cycle of relative rotation of the cylinder block and of the cam, there is at least one simultaneous situation during which said affiliated pistons co-operate with identical cam lobes and throughout their co-operation with said identical cam lobes, are in identical positions relative to said cam lobes, and wherein, for each of said identical cam lobes with which the affiliated pistons of said group co-operate, the angular positions of the starts and of the ends of each isolation stage relative to the dead center arcs of said lobes that are associated with each isolation stage are offset.

19. The machine according to claim 1, having a plurality of operating cylinder capacities corresponding to sub-machines all in simultaneous fluid communication with the same main ducts, wherein the pistons comprise at least two groups of affiliated pistons for which, during a cycle of relative rotation of the cylinder block and of the cam and in at least one configuration said affiliated pistons co-operate with identical cam lobes, throughout their co-operation with said identical cam lobes, in identical positions relative to said cam lobes, said two groups of affiliated pistons comprising a group of affiliated pistons from within the same sub-machine, and a group of affiliated pistons from among different sub-machines, and wherein, for each of the identical cam lobes with which affiliated pistons from within the same sub-machine co-operate, the angular positions of the starts and ends of each isolation stage relative to the dead center arcs of the lobes that are associated with each isolation stages are identical, while, for each of the identical cam lobes with which affiliated pistons from among different sub-machines co-operate, the angular positions of the starts and ends of each isolation stage relative to the dead center arcs of said lobes that are associated with each isolation stage are offset.

20. The hydraulic machine according to claim 1, wherein at the top dead center arc, the radial distance from the cam to the axis is at a maximum and that, at the bottom dead center arc, the radial distance from the cam to the axis is at a minimum.

* * * * *